United States Patent [19]

Rogers

[11] 4,080,851

[45] Mar. 28, 1978

[54] VARIABLE RACKET WRENCH

[75] Inventor: Charles E. Rogers, Barksdale, La.

[73] Assignee: The Raymond Lee Organization, Inc., New York, N.Y.

[21] Appl. No.: 788,742

[22] Filed: Apr. 19, 1977

[51] Int. Cl.[2] ..... B25B 13/46

[52] U.S. Cl. ..... 81/60; 81/61

[58] Field of Search ..... 81/60–63.1, 81/58.2, 57.29

[56] References Cited

U.S. PATENT DOCUMENTS

| | | | |
|---|---|---|---|
| 493,273 | 3/1893 | Killinger | 81/58.2 |
| 2,758,493 | 8/1956 | Goldwater | 81/60 X |

FOREIGN PATENT DOCUMENTS

| | | | |
|---|---|---|---|
| 1,271,648 | 6/1968 | Germany | 81/57.29 |

*Primary Examiner*—James L. Jones, Jr.
*Attorney, Agent, or Firm*—Howard I. Podell

[57] ABSTRACT

A rachet wrench fitted with a rotatable wrench lug that completely encloses a non-circular wrench opening, when installed, with the wrench lug formed of two assembled units, one of which is detachable to permit the wrench lug to be installed sidewise about a fitting on a tube, pipe or cable. A handle joins a circular open wrench section formed of two fixed arcuate shaped jaws in which a first wrench unit is rotatably mounted, with the first wrench unit in the form of a split ring, of a profile similar to that of the two fixed jaws, with the opening of the split periphery section of the first wrench formed as the same size as that of the opening between the ends of the two fixed jaws. The second wrench unit is a split ring shape of a size to fit inside the first wrench unit and between the first wrench unit opening so that when the first wrench unit is assembled to the second wrench unit, they form a closed circular ring, the exterior of which is shaped with rachet teeth and the interior of which is shaped with flats of a size to fit about the exterior of a polygonal sectional nut or other torque fastener. Pawls are internally mounted to a pivotable selector unit so as to alternately grip the external rachet teeth of the assembled wrench units to permit rotation of the wrench unit alternately in one or the other direction, in the fixed wrench jaws, with respect to the handle and fixed jaws.

3 Claims, 4 Drawing Figures

VARIABLE RACKET WRENCH

SUMMARY OF THE INVENTION

My invention is a rachet wrench fitted with a rotatable wrench lug that completely encloses a non-circular wrench opening, when installed, with the wrench lug formed of two assembled units, one of which is detachable to permit the wrench lug to be installed sidewise about a fitting on a tube, piper or cable. A handle joins a circular open wrench section formed of two fixed arcuate shaped jaws in which a first wrench unit is rotatably mounted, with the first wrench unit in the form of a split ring, of a profile similar to that ot the two fixed jaws, with the opening of the split periphery section of the first wrench formed as the same size as that of the opening between the ends of the two fixed jaws. The second wrench unit is a split ring shape of a size to fit inside the first wrench unit and between the first wrench unit opening so that when the first wrench unit is assembled to the second wrench unit, they form a closed circular ring, the exterior of which is shaped with rachet teeth and the interior of which is shaped with flats of a size to fit about the exterior of a polygonal sectional nut or other torque fastener. Pawls are internally mounted to a pivotable selector unit so as to alternately grip the external rachet teeth of the assembled wrench units to permit rotation of the wrench unit alternately in one or the other direction, in the fixed wrench jaws, with respect to the handle and fixed jaws.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
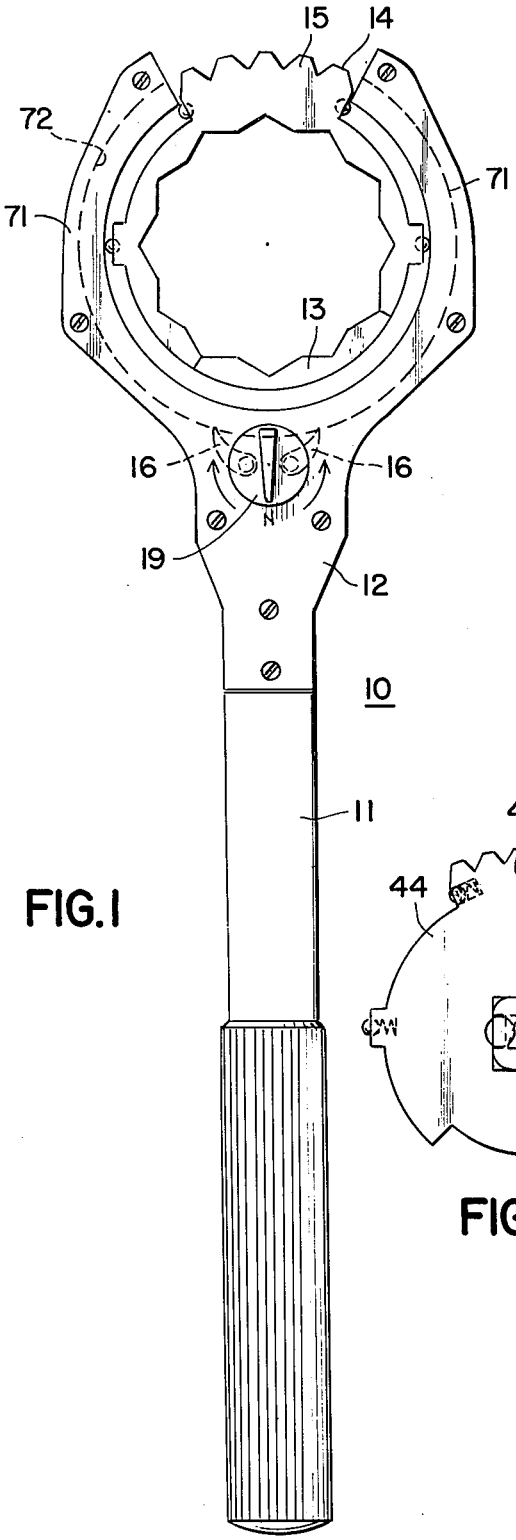
FIG. 1 is an elevation view of the rachet wrench.

Turning now descriptively to the drawings, in which similar reference characters denote similar elements throughout the several views, FIG. 1 illustrates racket wrench 10 which is formed of a straight handle section 11 joined to a wrench section 12 in which a composite wrench ring assembly 13 is rotatably mounted, with ring assembly 13 formed on its external rim 14 with racket teetj 15 that alternately engage one of two pivotally mounted pawls 16, 17 inside of wrench section 12 to permit ring assembly 13 to rotate in one of two directions dependent on the positioning of pawls 16, 17 by a rotatable pawl selection unit 19.

Figure 3:
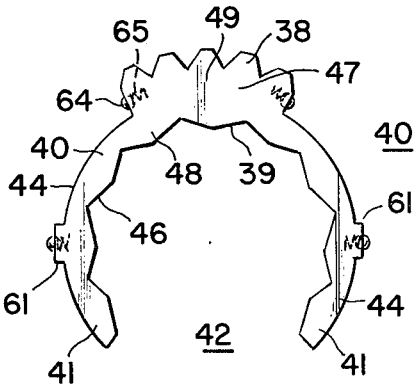
FIG. 3 is an elevation view of the second wrench unit.
Figure 2:
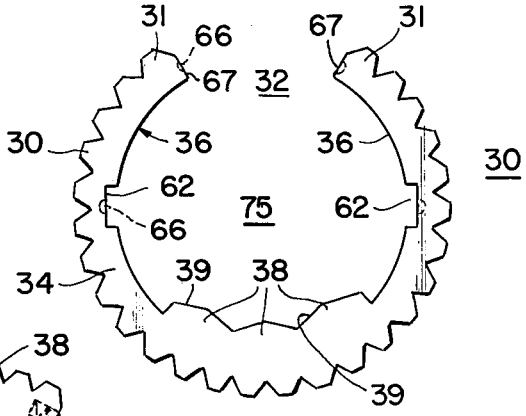
FIG. 2 is an elevation view of the first wrench unit.

Ring assembly 13 is formed of a first wrench unit 30 shown in FIG. 2 assembled to a second wrench unit 40 shown in FIG. 3.

First wrench unit 30 is of the shape of a split circular ring that extends about an arc of three hundred degrees with the opposed end sections 31 of the unit separated by an opening 32 of an arc of sixty degrees. The exterior surface of the rim 34 of unit 30 is shaped with projecting racket teeth 15. The internal face 36 of rim 34 is formed as a concave arc concentric with the pitch circle of teeth 15, except for a mid-section 37 of an arc of sixty degrees which is shaped with projections 38, the exterior surfaces of which are formed as flats 39 angled to grip the exterior flats of a polygonal shaped torque fastener.

Second wrench unit 40 is in the shape of a split ring that extends about an arc of three hundred degrees, with the opposed end sections 41 separated by an opening 42 of an arc of sixty degrees. The exterior surface of the rim 44 of unit 40 is shaped as a convex curved surface of a size to nest inside of the internal face 36 of rim 34 of first unit 30, except for a mid-section 47 of an arc extending sixty degrees which is externally shaped with projection section 49 in the form of racket teeth 15 of the pitch diameter of racket teeth 15 of unit 30. The internal face 46 of rim 44 is shaped with projections 48, the exterior surfaces of which are shaped with projections 48, the exterior surfaces of which are shaped as flats 39 of similar configuration and pitch circle to flats 39 of first unit 30, so that when first unit 30 is assembled about second unit 30, flats 39 of both units form a continuous uniform polygonal surface of three hundred and sixty degrees circumference 15 of both units from the teeth of a continuous gear of three hundred and sixty degrees.

Latching of the wrench units 30 and 40 is assured by shaped external detents 61 projecting beyond the external rim 44 of inner wrench unit 40 that engage shaped recesses 62 in internal face 36 of outer wrench unit 30. Ball detents 64, each biased by a compression spring 65 are mounted in detents 61 and in the opposed sides of projecting section 49 of inner wrench unit 40 and located to engage concave recesses 66 in recesses 62 and the end faces 67 of outer wrench unit 30 so as to provide sidewise latching of the assembled wrench units to form a ring unit 13.

Wrench section 12 terminates in a pair of circular fixed jaws 71 that enclose a circular slide 72 of a circumference to slidably and rotatably engage outer wrench unit 30 freely mounted in the slide 72 which is of a U-shaped cross-section, with jaws 71 being joined at their mid-section and extending about an arc of 300° so that when outer wrench unit 30 is rotatably aligned with jaws 71, inner wrench unit 40 may be attached to or removed from outer wrench unit 30.

Thus with inner wrench unit 40 detached from the tool 10, and with outer wrench unit 30 aligned with jaws 71, the opening 32 of outer wrench unit 30 permits sliding a tub (not shown) into the central opening 75 of the outer wrench unit 30.

Inner wrench unit 40 is similarly mounted about the said tube and engaged with outer wrench unit 30 to form a complete ring 13 and the assembled wrench unit is then moved axially along the tube to engage the external face of a polygonal fastener on said tube with the flats 39 of the wrench unit.

The assembled ring 13 may be then rotated in racket fashion by setting of the pawl selector unit 19.

Figure 4:
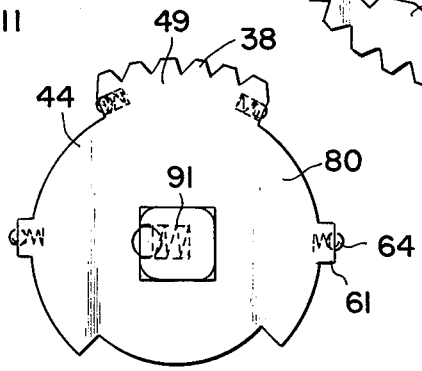
FIG. 4 is an elevation view of an alternate form of the second wrench unit.

FIG. 4 illustrates an alternate embodiment 90 of the inner wrench unit. Wrench unit 90 is of the external shape of inner wrench unit 40 but is formed with a completely enclosed central non-circular projecting lug 91 of a size to fit the drive socket of conventional wrench socket (not shown). Lug 91 is preferably of a square shape with rounded corners of a size to engage a drive socket of square cross-section so that a conventional socket wrench may be attached to said square lug 91.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A rachet wrench tool fitted with a rotatable wrench assembly externally shaped, when assembled, as a continuous rachet gear, said wrench assembly formed, when assembled, with a central opening continuously bounded by flats of a size to engage the external polygonal faces of a fastener, said wrench assembly formed of engaged outer and inner wrench units, each of which encompasses a circular arc of less than three hundred and sixty degrees, with the outer wrench unit being rotatably mounted in a recess of a jaw section of the tool and the inner wrench unit being detachable from said outer wrench unit, said jaw section being of the same profile as the outer wrench unit so that when the outer wrench unit is aligned with the jaw section, in profile, the inner wrench unit may be attached to or detached from said outer wrench unit, together with pawl means mounted in said tool to engage the rachet gear of the wrench assembly.

2. The combination as recited in claim 2 in which the jaw section, the outer wrench unit and the inner wrench unit each circumferentially encompass an arc of substantially similar magnitude.

3. The combination as recited in claim 1 together with an additional second inner wrench unit of similar external dimension to the first inner wrench unit, said second wrench unit completely fitted with a non-circular plug of a size to detachably engage a socket of a socket wrench.

* * * * *